US006523379B2

(12) United States Patent
Teskey

(10) Patent No.: US 6,523,379 B2
(45) Date of Patent: Feb. 25, 2003

(54) LOCKING CYLINDER AND HOUSING

(75) Inventor: Robert Teskey, Newport Coast, CA (US)

(73) Assignee: Ryadon, Inc., Foothill Ranch, CA (US)

( * ) Notice: Subject to any disclaimer, the term of this patent is extended or adjusted under 35 U.S.C. 154(b) by 132 days.

(21) Appl. No.: 09/839,382

(22) Filed: Apr. 20, 2001

(65) Prior Publication Data

US 2002/0152781 A1 Oct. 24, 2002

(51) Int. Cl.[7] ..... E05B 9/04

(52) U.S. Cl. ..... 70/371; 70/370; 70/372; 70/451; 70/466

(58) Field of Search ..... 70/129, 134, 490, 70/370–372, 375, 447–451, 466, 373, 381

(56) References Cited

U.S. PATENT DOCUMENTS

| | | | | | |
|---|---|---|---|---|---|
| 2,040,258 | A | * | 5/1936 | Jacobi | 70/370 |
| 2,549,724 | A | * | 4/1951 | Tinnerman | 70/370 |
| 2,629,248 | A | * | 2/1953 | Burdick | 70/370 |
| 2,633,011 | A | * | 3/1953 | Poupitch | 70/370 |
| 4,297,862 | A | * | 11/1981 | Solovieff | 70/129 |
| 4,316,371 | A | * | 2/1982 | Del Nero | 70/417 |
| 4,381,656 | A | * | 5/1983 | Hayakawa | 70/451 |
| 4,706,478 | A | | 11/1987 | Swan et al. | 70/28 |
| 4,756,638 | A | * | 7/1988 | Neyret | 403/261 |
| 4,765,165 | A | * | 8/1988 | O'Gara | 70/417 |
| D324,636 | S | | 3/1992 | Schlack | D8/331 |
| 5,265,454 | A | | 11/1993 | Crocco et al. | 70/101 |
| 5,297,405 | A | * | 3/1994 | Manning et al. | 70/208 |
| D357,396 | S | | 4/1995 | Ziemer | D8/331 |
| 5,493,883 | A | * | 2/1996 | Myers | 70/373 |
| 5,551,268 | A | * | 9/1996 | Carnes et al. | 70/370 |
| 5,794,472 | A | | 8/1998 | Kester | 70/472 |
| 5,884,948 | A | | 3/1999 | Weinerman et al. | 292/216 |
| 5,890,753 | A | | 4/1999 | Fuller | 292/337 |

* cited by examiner

*Primary Examiner*—Lynne H. Browne
*Assistant Examiner*—John B. Walsh
(74) *Attorney, Agent, or Firm*—Fulwider Patton Lee & Utecht, LLP

(57) ABSTRACT

A locking mechanism having a housing with an aperture having at least one notch and providing access to a latching mechanism for a cylindrical lockset having a barrel section with an outwardly projecting tab which may be inserted through the aperture and to engage the latching mechanism being rotatable to engage the tab with the inner surface of the housing inhibiting removal of the lockset. A set screw mounted on the housing is incorporated to prevent rotation of the lockset by engaging a groove in the barrel section.

11 Claims, 2 Drawing Sheets

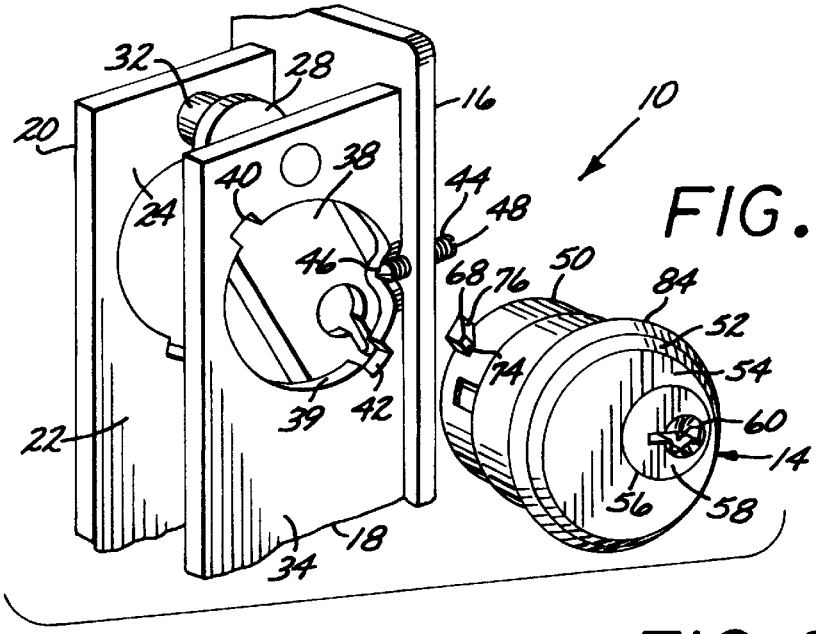
FIG. 1
FIG. 2
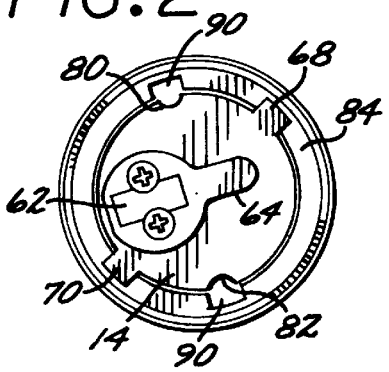
FIG. 3
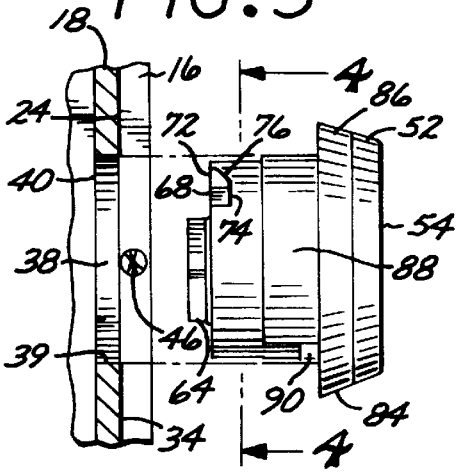
FIG. 4
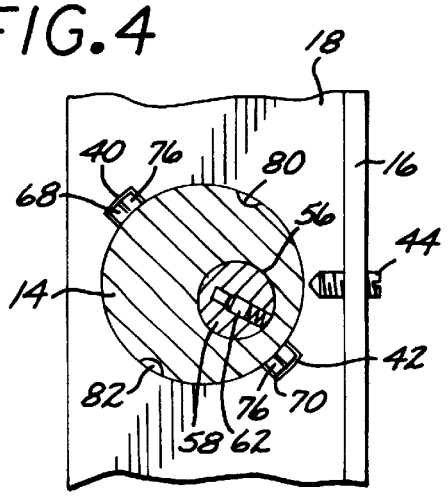
FIG. 5
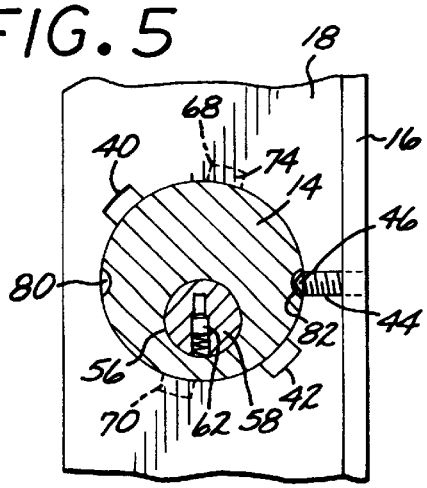

LOCKING CYLINDER AND HOUSING

BACKGROUND OF THE INVENTION

1. Field of the Invention

The invention relates generally to mechanical locks and more specifically relates to the installation and removal of cylinder type locks to and from a housing.

2. Description of the Prior Art

Installation of locks for hinged swinging glass doors or other doors is often a time consuming process that involves installing both a housing in one part of the framework and a latch receptacle in the other part of framework to be secured. In many cases, the locking elements are permanently installed into the housing. However replacement of the locking mechanism is often required when the occupants move or when the lock has been damaged due to theft or other occurrence.

A removable lock cylinder has been developed that may be removed and installed without removing the associated housing. Such removable lock cylinders typically include machined threads having a narrow pitch. The associated housing also includes a threaded bore of a complementary pitch such that the lock cylinder may be threaded into a housing and inhibit the outward movement of the lock cylinder relative to the housing. A set screw is commonly used to inhibit rotational movement of the lock cylinder relative to the housing.

There are several drawbacks to this common means of installation. First of all, both the lock cylinder and housing must be machined with threads. Often a larger portion than is necessary is threaded to accommodate housings of different dimensions or framework of varying thickness. In addition, during installation or removal, the threading and unthreading of the locking cylinder takes a significant amount of time. Due to the narrow pitch, damage to either the threading in the bore or on the locking cylinder may cause a misalignment between the two elements and inhibit proper installation and can also destroy the threads on the cylinders which are made from brass or zinc.

What is needed is a relatively simplified and inexpensive system and method for installing and replacing cylinder locks saving both manufacturing time and installation time thus reducing the overall costs for both the manufacturer and the installer.

SUMMARY OF THE INVENTION

In accordance with a preferred embodiment of the present invention, a quick removable cylindrical lockset is provided for use in conjunction with a housing having an aperture wall defining an aperture with a predetermined diameter to provide access to the interior of the housing which contains a latching mechanism. The aperture also includes at least one notch projecting radially outwardly from the aperture wall. A set screw is mounted from the housing to engage a groove in the barrel section of the cylinder which also includes a keyhold plug insert. At least one tab projecting radially outwardly from the barrel may be inserted through the notch such that the barrel section may be rotated to engage the tab against the interior surface of the housing to resist removal of the lockset relative to the housing.

In another embodiment the aperture includes a pair of diametrically opposed notches and the barrel section of the cylindrical lockset includes a pair of diametrically opposed tabs for alignment with said notches during insertion of the lockset into the housing.

In yet another embodiment, a sleeve is provided for placement around the lockset to provide a trim or finishing piece between the lockset and surrounding framework.

Another embodiment includes a latch bolt retractor and latch bolt mounted in a latching compartment in the housing and coupled to a throw on the cylindrical lockset when the lockset is installed.

A method for installing and removing such lockset is also provided herein.

BRIEF DESCRIPTION OF THE DRAWINGS

FIG. 1 is a perspective, fragmentary, exploded view of a housing, latch bolt, retractor, and latch bolt embodying the present invention;

FIG. 2 is a bottom view of the locking cylinder of the embodiment shown in FIG. 1;

FIG. 3 is a side view of the locking cylinder along with a side sectional view of the housing of the embodiment depicted in FIG. 1;

FIG. 4 is sectional view taken along lines 4—4 as shown in FIG. 3;

FIG. 5 is the same view as shown in FIG. 4 with the locking cylinder rotated and the set screw engaged;

Figure 6:
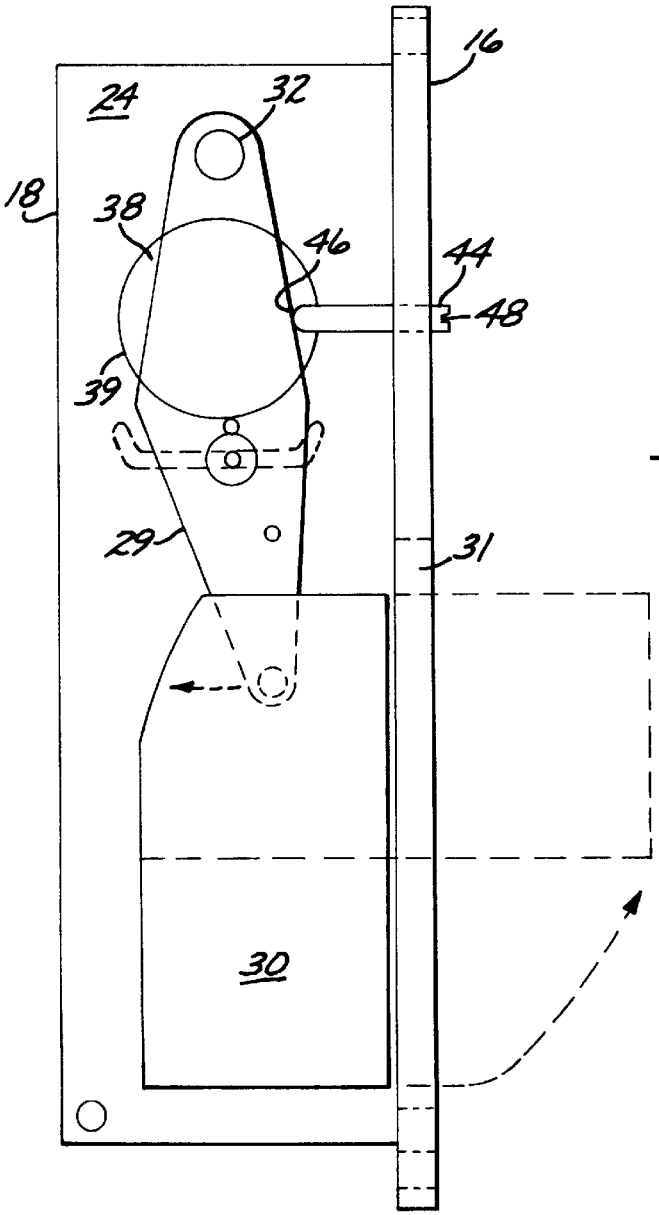
FIG. 6 is a side view in enlarged scale of a housing, latch bolt retractor, and latchbolt with one anchor plate removed embodying the present invention.
Figure 7:
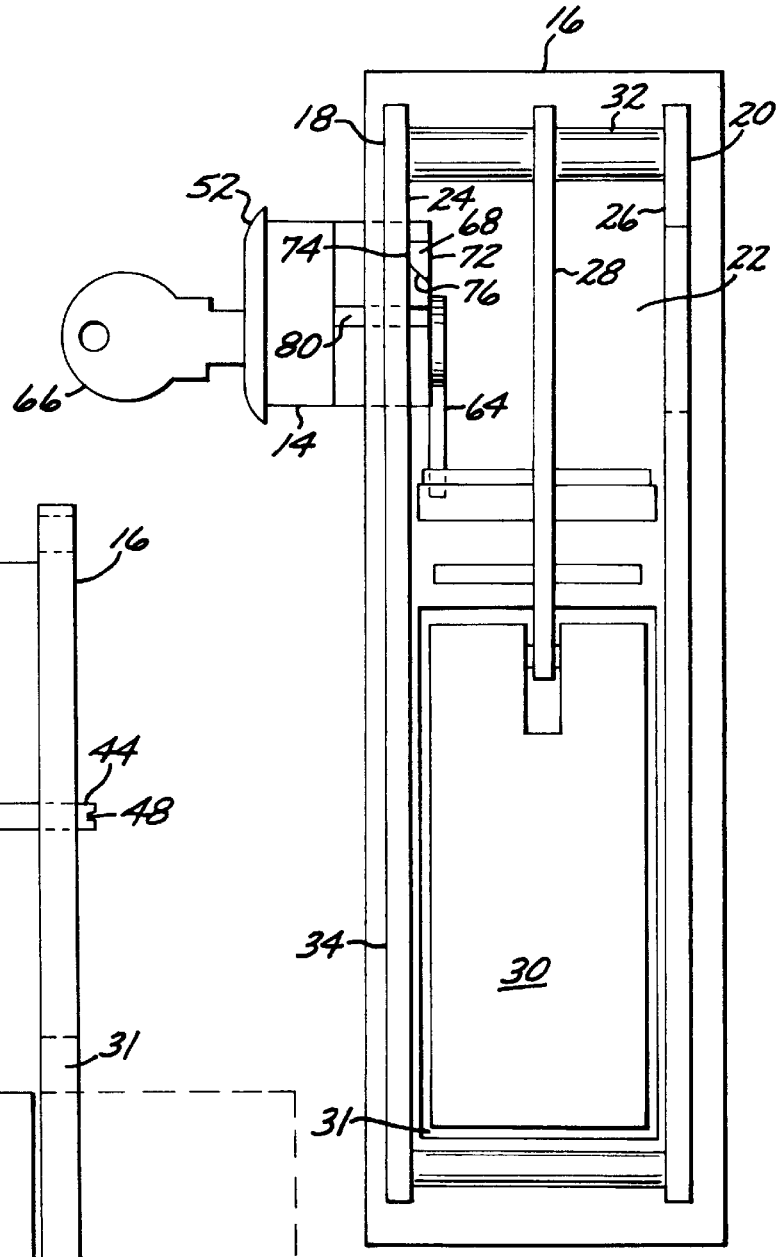
FIG. 7 is a bottom view in enlarged scale of locking cylinder and housing embodying the present invention.

Numerous advantages and aspects of the invention will be apparent to those skilled in the art upon consideration of the following detailed description taken in conjunction with the drawings which generally provide illustrations of the invention in its presently preferred embodiments.

DETAILED DESCRIPTION OF THE PREFERRED EMBODIMENT

Referring now to FIGS. 1–3, a locking mechanism, generally designated 10, is illustrated which advantageously is relatively inexpensive to manufacture and significantly reduces installation and removal time and eliminates cross threading and thread damage. In general terms, the locking mechanism includes a housing, generally designated 12, for mounting to a structure to be secured such as a door and a removable cylindrical lockset, generally designated 14. In general terms, the housing is generally channel shaped with a rectangular base plate 16 supporting two rectangular, orthogonally projecting, spaced apart, anchor plates 18 and 20 to form a latching compartment 22 between their respective inner surfaces 24 and 26 of the anchor plates. The anchor plates are welded or otherwise suitably secured to the base plate along their top edges. Each anchor plate is identical in construction and advantageously constructed to provide a reversible locking mechanism to allow installation from either side. In other words, the housing is generally symmetrical about a plane passing through the central longitudinal axis of the base plate. Thus, it will be appreciated that either anchor plate could be omitted without detracting from the scope and spirit of the invention. The housing is typically formed of hardened steel or other suitable material commonly used in the lock industry.

The anchor plates 18 and 20 generally carry a latch bolt retractor or transfer mechanism 28 and a latch bolt 30, the construction and workings of which are well known in the art. In general terms the latch bolt retractor 28 is an elongated plate pivotally connected at one end to an anchor pin 32 supported between the two anchor plates 18 and 20. The opposing end of the latch bolt retractor 28 is pivotally coupled to the latch bolt 30 to toggle the latch bolt between a latched position (FIG. 6) shown in phantom lines projecting through a slot 31 in the housing to extend outside the latching compartment and an unlatched position fully nested within the housing as depicted in solid lines in FIG. 6. It will be appreciated that any type of latch retractor and latch bolt assembly that are commonly used in conjunction with a cylinder lock may be incorporated into the present invention without detracting from the scope and spirit of the present invention.

Since the anchor plates 18 and 20 are identical, one plate 18 will be described and it will be assumed that like numerals indicated in the drawings refer to like components unless otherwise indicated. Anchor plate 18 includes an outer surface 34 and an inner surface 24 with a circular aperture 38 extending between the two surfaces. Extending radially outwardly from the peripheral wall 39 of the aperture 38 is a pair of diametrically opposed generally rectangular notches 40 and 42, the purpose of which will be described in more detail below. Threaded bores are disposed near the outer edges of the base plate 16 to receive a set screw 44 which projects in the direction of the anchor plate 18 along its outside surface 34. Such set screw is threaded and dimensioned to project inwardly such that the inside tip 46 may project inside a cylindrical projection of the aperture 38, the function of which will be described below. The set screw is conveniently provided with a slot 48 for receipt of a tool such as a flathead screwdriver to turn it within its bore.

Referring now to FIGS. 1–3 and 7, the cylinder lock 14 is in the form of a shell including a barrel section 50 projecting from a flared head 52 which includes a face 54 or outer surface that is visible after installation. Projecting through the length of the shell is a rotatable plug aperture 56 for receipt of a plug insert 58 having a keyhole 60 at one end connected via a keyway 62 to a throw 64 at the opposing end of the plug insert 58. The keyhole is flush with the face of the flared head 52 of the shell. The throw 64 is constructed to actuate the latch retractor 28 when the locking cylinder is installed and the proper key 66 is turned.

The outer surface of the barrel section 50 includes a pair of diametrically opposed anchor tabs 68 and 70 for the purpose of restricting the outward movement of the lock cylinder 14 after it has been installed in the housing 12. Each tab projects radially outwardly from the surface of the barrel section in an orthogonal direction. The tabs are generally trapezoidally shaped and have a bottom surface 72 flush with the inner end of the locking cylinder 14 and an upper abutment surface 74 separated by a ramp 76 inclined on the side toward the fastening direction which, as illustrated in FIGS. 1 and 4, is the clockwise direction. The ramps 76 assist in drawing the inner end of the lock cylinder 14 into the latching compartment 22 by slidably engaging the aperture wall 39 during rotation of the barrel section 50. The ramps are preferably angled about 40–50 degrees from a plane passing through the inner end of the barrel section. The abutment surface 74 is positioned to engage and lie flush against the interior surface 24 of the anchor plate 18 when the lock cylinder 14 is installed in the housing 12. Thus when the locking cylinder is properly engaged the outwardly projecting tabs 68 and 70 abut the interior surface 24 of the anchor plate 18 and inhibit the lock cylinder 14 from being pulled outwardly through the anchor plate 18 and away from the housing 12.

The barrel section 50 further includes a pair of diametrically opposed grooves 80 and 82 having a semi-cylindrical recess indented from the outer surface of the barrel section and projecting about half the length of the barrel section. One of the grooves cooperates with the set screw 44 to inhibit the lock cylinder 14 from rotating relative to the housing 12. Thus, when the set screw engages a groove 80 or 82 on the barrel section 50, the barrel section may not rotate and inadvertently align the tabs 68 and 70 with the aperture notches 40 and 42. The grooves are spaced from the ramps around the circumference about 55–65 degrees in the counterclockwise direction when viewed from the inner end of the barrel section 50 as illustrated in FIG. 2.

For purposes of a tighter fit between the housing and the shell, to form a water barrier, and form an aesthetic trim piece, a sleeve 84 is used. Such sleeve includes a collar 86 which is formed to abut the flared head 52 section of the shell 14. The angle of the flare is generally selected to blend with the flared head section of the lock cylinder to provide an aesthetically pleasing appearance between the lock cylinder and the door that it is installed in. Projecting rearwardly of the collar is an elongated cylindrical section 88 that covers about two-thirds of the barrel section 50 in a close fitting relationship. The elongated cylindrical section 88 includes slots 90 that project along the elongated section 88 and also extend outwardly into the collar. Such slots are aligned for sliding receipt of tabs 68 and 70 so as not to interfere with placement of the sleeve over the lock cylinder while exposing the tabs when the lock cylinder 14 is installed. The sleeve may be manufactured of plastic, metal or other suitable material as desired.

Referring now to FIGS. 3–5, during installation the housing 12 is installed in the workpiece such as a door or frame as is conveniently carried out in the art. In general terms the base plate is fastened or otherwise secured to the frame or door. The opposing structure to be secured such as a door jamb would have a latch bolt receptacle fastened therein. When the lock cylinder 14 is ready to be installed, the installer takes sleeve 84 and aligns the slots 90 with the tabs 68 and 70 and slides the sleeve 84 over the barrel section 50 until the collar 86 is abutting the flared head section 52 of the lock cylinder. The installer then grasps the flared head section 52 or cap of the lock cylinder 14 and aligns the tabs 68 and 70 with notches 40 and 42 and slides the barrel section 50 through the aperture 38 until the tabs are clear of the aperture wall 39 and the barrel 50 may be rotated. The lock cylinder 14 is rotated until one of the grooves 80 or 82 is aligned with the set screw 44. The set screw is then rotated using a tool such as flathead screwdriver and rotated clockwise to tighten the screw against the lock cylinder. The tip 46 of the set screw nests within the groove 80 or 82 and prohibits rotation of the lock cylinder by interfering with the side walls of the groove.

In the event of a tight fit, the ramps 76 may provide the additional leverage to assist in drawing the lock cylinder 14 into housing 12. Once the ramps engage the edges of the aperture wall 39, further rotation will be translated into an inwardly pulling force to pull the tabs 68 and 70 clear of the anchor plate aperture wall 39 until their respective abutment surfaces 74 may be slid inside the inner surface 24 of the anchor plate 18 to rest there against.

If the locking cylinder is already installed, it is a simple matter to unthread the set screw 44 and rotate the anchor tabs 68 and 70 in a reverse direction until they are aligned with the notches 40 and 42 and withdraw the lock cylinder from the housing.

It will be understood the interaction between and construction of the shell and plug insert are well known in the art. In general terms, a key 66 is inserted into the keyhole 60 and through the keyway 62. If the proper key is used then internal pins are displaced and the key may be inserted all the way through the keyway to engage the throw 64 and then rotated to turn the throw 64 which is coupled to the latch bolt retractor 28 which in turn toggles the latch bolt 30 between a latched and unlatched position.

While several forms of the present invention have been illustrated and described, it will also be apparent that various modifications may be made without departing from the spirit and scope of the invention. Furthermore, while the preferred embodiment of the invention has been described in terms of the dimensions and cross-sectional configurations of various components of the invention it is understood that the invention is not intended to be limited to those specific dimensions or configurations but is to be accorded the full breadth and scope of the claims appended hereto.

What is claimed is:

1. A quick removable cylindrical lockset for use in conjunction with a housing having an aperture wall defining an aperture with a predetermined diameter therebetween, said aperture providing access between an outer surface and an inner surface of said housing and further including a pair of circumferentially spaced notches extending radially outwardly from said aperture wall, said housing further including at least one set screw, said cylindrical lockset comprising:

a shell element including a cylindrical barrel section with a diameter less than said predetermined diameter and having a keyhole plug insert projecting longitudinally throughout, said shell element further including projecting along a length of an outer surface of said barrel section and constructed to receive a tip of said set screw, said barrel section further including a pair of diametrically opposed tabs projecting radially outwardly from said barrel section and spaced around a circumference of said barrel section to align with said notches for insertion therein; and whereby said tabs may be aligned with said notches and said barrel section inserted into said aperture such that said tabs clear said aperture wall and said shell element may be rotated to position said tabs out of alignment with said notches and said set screw may be engaged in said groove such that rotational and outward movement of said shell relative to said housing is inhibited.

2. The quick removable cylindrical lockset as set forth in claim 1 wherein:

each of said tabs includes an abutment surface for nesting against said inner surface of said housing when said lockset is installed.

3. The quick removable cylindrical lockset as set forth in claim 1 wherein:

each of said tabs includes a ramp for slidably engaging said aperture wall during installation.

4. The removable cylindrical lockset as set forth in claim 3 wherein:

said ramps are angled 55–65 degrees from a plane formed by the inner end of said barrel section.

5. The removable lockset as set forth in claim 1 further including:

a sleeve having a collar and a pair of diametrically opposed longitudinally extending slots for slidable receipt of said barrel section.

6. The removable lockset as set forth in claim 1 wherein:

said barrel section includes a pair of diametrically opposed grooves offset around the circumference of said barrel section from said tabs.

7. A locking mechanism comprising:

a channel shaped housing having a pair of spaced apart anchor members extending from a base member to form latching compartment therebetween, at least one of said anchor members having an aperture with a predetermined diameter providing access to said latching compartment and at least one outwardly extending notch;

a latch bolt retractor mounted to said anchor members in said compartment and coupled to a latch bolt constructed to move from a latching position to an unlatching position;

a set screw mounted from said housing and including a tip capable of moving inside a cylindrical projection of said aperture;

a locking cylinder having a barrel section with a plug insert having a keyhole at one end and a throw at an opposing end connected by a keyway, said barrel section further having a diameter less than said predetermined diameter and including at least one outwardly projecting flange configured to pass through said notch to be disposed within said latching compartment and a groove projecting longitudinally along an outside surface of said barrel section; and whereby said locking cylinder may be installed in said housing by aligning said flange with said notch and inserting said barrel section in said aperture such that said barrel section may be rotated to align said groove with said set screw which may be engaged and said flange is disposed within said latching compartment such that said locking cylinder is inhibited from moving away from and rotating relative to said housing and said throw is positioned to actuate said latch bolt retractor to alternate said latch bolt between said positions.

8. A locking mechanism having a housing with a latch bolt retractor and latch bolt coupled together and mounted between the inside surfaces of a pair of anchor plates, at least one of said anchor plates having an aperture for receipt of a cylinder lock, said housing further including a set screw having a tip movable between an engagement position and a disengagement position, said locking mechanism comprising:

at least one notch projecting radially outwardly from a circumference of said aperture;

a removable locking cylinder including a barrel section having an elongated cylindrical plug insert with a keyhole at one end and a throw at the opposing end with a keyway projecting throughout its length for insertion of a key, said barrel section including at least one radially outwardly projecting tab having an abutment surface and dimensioned to clear said notch as said locking cylinder is inserted into said aperture, said barrel further including at least one groove dimensioned to receive said tip of said set screw for inhibiting rotational movement of said locking cylinder;

whereby said tab may be aligned with said notch and said locking cylinder may be inserted into said aperture of said anchor plate and rotated such that said abutment surface of said tab is flush against said inside surface of said anchor plate with said aperture and said groove is aligned with said set screw which may be placed in said engagement position to inhibit rotational movement of said locking cylinder relative to said anchor plate and said throw is positioned to actuate said latch bolt retractor.

9. A locking mechanism comprising:

a housing including a base plate with an anchor plate projecting orthogonally therefrom, said anchor plate having an inner surface and a circular aperture with at least one notch projecting radially outwardly from said aperture;

at least one set screw threadably mounted from said base plate and projecting parallel to said anchor plate and having a tip movable from an engagement position to a disengagement position;

a removable locking cylinder including a shell with a rotatably mounted plug having a key hole disposed at one end and a throw at an opposing end, said shell further including at least one groove for inhibiting rotation of said shell in relation to said housing when said set screw is disposed in said engagement position, said shell further including at least one radially projecting tab dimensioned to be passed through said notch and having an abutment surface;

a latching retractor rotatably mounted from said anchor plate and coupled to said throw when said locking cylinder is installed;

a latching element coupled to said retractor and constructed to move from a latching position to an unlatching position; and whereby said tab may be linearly aligned with said notch and said shell inserted through said aperture and rotated until said groove is aligned with said set screw such that said abutment surface abuts said inner surface of said anchor plate to inhibit said shell from being removed from said housing and said set screw may be placed in said engagement position to engage said groove to inhibit said shell from rotating relative to said housing.

10. A method for installing a removable locking cylinder comprising the steps of:

providing a housing with a base plate and an orthogonally projecting anchor plate and a latch bolt retractor rotatably mounted to said anchor plate and coupled to a latch bolt, said anchor plate including an aperture with a predetermined diameter and projecting between an outer surface and an inner surface and further having at least one notch extending radially outwardly from a periphery of said aperture;

providing a set screw threadably mounted to said base plate and having a tip movable to an interior of a cylindrical projection formed by said aperture;

fastening said base plate to a framework to be secured;

providing a locking cylinder having a barrel section with a diameter less than said predetermined diameter and further including an outwardly projecting flange including an abutment surface dimensioned to clear said notch, said barrel further including a longitudinally projecting groove on its outer surface;

aligning said flange with said notch and inserting said locking cylinder into said aperture such that said abutment surface is disposed interior of said inner surface of said anchor plate;

rotating said locking cylinder approximately a quarter turn to move said flange out of alignment with said notch, to seat said abutment surface against said inner surface, and move said groove into alignment with said set screw; and engaging said groove with said set screw to inhibit rotational movement of said locking cylinder relative to said anchor plate.

11. A method for removing a removable locking cylinder held in place by a set screw and a flange in a housing secured to a framework and having an anchor plate with an aperture and at least one outwardly projecting notch comprising the steps of:

rotating a set screw to disengage said screw from said lock cylinder;

rotating said locking cylinder until said flange is aligned with said notch; and withdrawing said lock cylinder from anchor plate until said flange is clear of said aperture.

* * * * *